US011434599B2

(12) United States Patent
Lee et al.

(10) Patent No.: US 11,434,599 B2
(45) Date of Patent: Sep. 6, 2022

(54) DRAWER GUIDE AND LAUNDRY TREATMENT APPARATUS HAVING THE SAME

(71) Applicant: LG ELECTRONICS INC., Seoul (KR)

(72) Inventors: Jihong Lee, Seoul (KR); Kwanwoong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/050,706

(22) PCT Filed: Apr. 16, 2019

(86) PCT No.: PCT/KR2019/004564

§ 371 (c)(1),
(2) Date: Oct. 26, 2020

(87) PCT Pub. No.: WO2019/208964

PCT Pub. Date: Oct. 31, 2019

(65) Prior Publication Data

US 2021/0230784 A1 Jul. 29, 2021

(30) Foreign Application Priority Data

Apr. 27, 2018 (KR) ..... 10-2018-0049127

(51) Int. Cl.
*D06F 39/12* (2006.01)
*A47B 88/453* (2017.01)
(Continued)

(52) U.S. Cl.
CPC ..... *D06F 39/12* (2013.01); *A47B 88/453* (2017.01); *D06F 23/04* (2013.01); *D06F 31/00* (2013.01); *D06F 37/18* (2013.01); *D06F 37/28* (2013.01)

(58) Field of Classification Search
CPC ..... D06F 37/24; D06F 31/00; D06F 37/20; D06F 37/28; D06F 37/18; D06F 23/04;
(Continued)

(56) References Cited

U.S. PATENT DOCUMENTS 6,979,066 B2 * 12/2005 Yang ..... A47B 88/467 312/319.1
7,244,005 B1 * 7/2007 Lu ..... A47B 88/467 312/319.1
(Continued)

FOREIGN PATENT DOCUMENTS

CN 101606790 A 12/2009
CN 102203367 A 9/2011
(Continued)

OTHER PUBLICATIONS

Australian Office Action, dated Oct. 27, 2021, issued in Australian Patent Application No. 2019261472 (7 pages).
(Continued)

*Primary Examiner* — David G Cormier
*Assistant Examiner* — Thomas Bucci
(74) *Attorney, Agent, or Firm* — Birch, Stewart, Kolasch & Birch, LLP

(57) ABSTRACT

A drawer guide includes a fixed body; an operation body withdrawable from the fixed body; a base; and a base slit. The base slit includes a linear portion; and a curved portion extending from a front end of the linear portion. The drawer guide includes first and second slides movably coupled to the base; a slide slit penetrating the second slide; a first transfer unit having one end movably coupled to the base slit and the other end inserted in the slide slit; a second transfer unit detachably coupled to the first transfer unit. The second transfer unit moves the first transfer unit to the curved portion from the linear portion when the operation body is
(Continued)

moved in the withdrawing direction and vice-versa. The drawer guide includes a spring connecting the base and the first slide; and an attractive power supply unit that supplies a power to the second slide.

19 Claims, 11 Drawing Sheets

(51) Int. Cl.
*D06F 31/00* (2006.01)
*D06F 23/04* (2006.01)
*D06F 37/18* (2006.01)
*D06F 37/28* (2006.01)

(58) Field of Classification Search
CPC ..... D06F 39/12; A47B 88/467; A47B 2210/0018; A47B 2210/0059; A47B 2210/0094; A47B 88/49; A47B 2210/0016; A47B 2210/004; A47B 2210/0054; A47B 2210/0091; A47B 88/437; A47B 88/50; A47B 88/57; A47B 2210/0002
USPC ..... 68/13 R; 312/334.8, 333, 319.1, 334.1, 312/330.1
See application file for complete search history.

(56) References Cited

U.S. PATENT DOCUMENTS 7,374,261 B1 * 5/2008 Wang ..... A47B 88/463 312/319.1
7,758,134 B2 * 7/2010 Huang ..... A47B 88/49 312/334.47
7,815,267 B1 * 10/2010 Frousiakis ..... A47B 88/467 312/319.1
8,083,304 B2 * 12/2011 Hu ..... A47B 88/467 312/319.1
8,256,853 B2 * 9/2012 Chen ..... F16C 29/02 312/334.47
8,496,306 B2 * 7/2013 Chen ..... A47B 88/463 312/319.1
8,556,305 B2 * 10/2013 Juan ..... A47B 88/463 292/164
8,696,077 B2 * 4/2014 Huang ..... A47B 88/467 312/319.1
8,801,120 B2 * 8/2014 Chen ..... A47B 88/47 312/333
8,888,200 B2 * 11/2014 Sato ..... E05F 5/003 312/319.1
9,375,083 B2 * 6/2016 Haemmerle ..... A47B 88/473
9,648,952 B2 * 5/2017 Nuckolls ..... A47B 88/487
9,872,563 B2 * 1/2018 Davis ..... A47B 88/473
9,877,582 B2 * 1/2018 Zhu ..... A47B 88/49
9,930,962 B2 * 4/2018 Chen ..... A47B 88/49
9,968,193 B1 * 5/2018 Chen ..... A47B 88/467
2005/0093406 A1 * 5/2005 Yang ..... A47B 88/467 312/333
2008/0197759 A1 * 8/2008 Chen ..... A47B 88/467 312/334.1
2009/0115300 A1 * 5/2009 Chen ..... H05K 7/1421 312/334.1
2010/0040313 A1 * 2/2010 Juang ..... A47B 88/49 384/21
2010/0164340 A1 * 7/2010 Juan ..... A47B 88/467 312/333
2011/0138801 A1 * 6/2011 Zimmer ..... A47B 88/457 60/527
2011/0154817 A1 * 6/2011 Zimmer ..... F03G 7/065 60/528
2011/0156561 A1 * 6/2011 Salice ..... A47B 88/47 312/319.1
2011/0175508 A1 * 7/2011 Rechberg ..... A47B 88/467 16/49
2012/0144622 A1 * 6/2012 Juan ..... A47B 88/467 16/72
2014/0053612 A1 2/2014 Son et al.
2014/0346941 A1 * 11/2014 Gasser ..... A47B 88/467 312/334.1
2015/0069896 A1 * 3/2015 Salice ..... A47B 88/57 312/319.1
2015/0131929 A1 * 5/2015 Park ..... A47B 88/467 384/21
2018/0132615 A1 * 5/2018 Kim ..... F16C 29/02

FOREIGN PATENT DOCUMENTS

CN 103735058 A 4/2014
CN 104997305 A 10/2015
CN 105316900 A 2/2016
DE 202006006179 U1 8/2007
EP 3 064 637 A1 9/2016
JP 2017-180770 A 6/2017
KR 10-1114477 2/2012
KR 10-1364867 2/2014
KR 10-2015-0130880 11/2015
WO WO 2007/139364 A1 12/2007
WO WO-2007139364 A1 * 12/2007 ..... A47B 88/427

OTHER PUBLICATIONS

PCT Search Report, dated Aug. 2, 2019, issued in PCT International Patent Application No. PCT/KR2019/004564 (3 pages).

* cited by examiner

DRAWER GUIDE AND LAUNDRY TREATMENT APPARATUS HAVING THE SAME

TECHNICAL FIELD

Embodiments of the present disclosure relate to a drawer guide that facilitates the retracting of a drawer and a laundry treatment having the same.

BACKGROUND

A device that is often called a drawer guide or a draw to slide is the means that facilitates the retracting of a drawer with respect to a cabinet provided in an electronic appliance. Such a device is used in the furniture such as a desk or a closet. A conventional drawer guide may include a fixed body fixed to a cabinet; and an operation body coupled to the drawer, with an extendable structure configured to be withdrawable from the fixed body.

The conventional drawer guide having the above-mentioned structure is able to withdraw or insert the drawer from or in the cabinet by using the external force applied by a user. In case the drawer is inserted in the cabinet, different from the case in that facilitates the withdrawing of the drawer from the cabinet, an excessive external force might be applied to the drawer enough to cause the collision between the drawer and the cabinet and the cabinet or drawer might damage disadvantageously.

Moreover, the conventional drawer guide has another disadvantage that the drawer might be withdrawn by the vibration generated in the drawer even unless the user applies an external force to the drawer.

SUMMARY

Technical Problem

To overcome the disadvantages, an object of the present disclosure is to address the above-noted and other problems and provide a drawer guide that is able to generate a force used in moving the drawer towards the inside of a cabinet, when a drawer is spontaneously moved a preset reference distance towards a cabinet a laundry treatment apparatus having the same.

Another object of the present disclosure is to provide a drawer guide that supplies a preset force to keep the inside of the cabinet in a pressed state so as to enable a drawer to be withdrawn from the cabinet only when a preset reference external force or more is applied to the drawer and a laundry treatment apparatus having the same.

Technical Solution

To achieve these objects and other advantages and in accordance with the purpose of the embodiments, as embodied and broadly described herein, a drawer guide comprises a fixed body; an operation body that is withdrawable from the fixed body; base provided in the fixed body; a base slit comprising a linear portion provided along the same direction with the moving direction of the operation body; and a curved portion upwardly or downwardly extended from a front end of the linear portion located in a withdrawing direction of the operation body, the base slit provided in the base; first and second slides movably coupled to the base to be movable along the base and to be movable in communication with each other; a slide slit provided to penetrate the second slide; a first transfer unit having one end movably coupled to the base slit and the other end inserted in the slide slit to penetrate the second slide; a second transfer unit provided in the operation body and detachably coupled to the first transfer unit, the second transfer unit configured to move the first transfer unit to the curved portion from the linear portion when the operation body is moved towards the withdrawing direction from the fixed body and the first transfer unit to the linear portion from the curved portion when the operation body is moved towards the inserting direction in the fixed body; a spring provided to connect the base and the first slide with each other and move the first slide towards a rear end of the linear portion wen the first transfer unit is moved to the linear portion from the curved portion; and an attractive power supply unit configured to supply a power to the second slide to move the second slide towards a rear end of the linear portion.

A period in which the second slide is supplied the power by the first slide and a period in which the second slide is supplied the other by the attractive power supply unit may be overlapped with each other.

A period in which the second slide is supplied the power by the first slide and a period in which the second slide is supplied the other by the attractive power supply unit may not be overlapped with each other.

The attractive power supply unit may be configured to supply an attractive power to the second slide at the moment when the second slide is moved a preset reference distance or more with respect to a front end of the linear portion.

The reference distance may be set as a ½ to ⅔ or more of the length of the linear portion with respect to the front end of the liner portion.

The first slide may comprise a first body; a first connection portion provided to movably couple the first body to the base, and the second slide may comprise a second body located in a rear area of the first body towards the rear end of the linear portion; and a second connection portion movably couple the second body to the base and located in a rear area of the first connection, and the slide slit penetrates the second body along a crossing direction with respect to the moving direction of the second body.

The first slide may comprise a first body; a first connection portion provided in each of the upper and lower ends of the first body and configured to movably couple the first body to the base; and a slide through-hole provided to penetrate the first body, and the second slide may comprise a second body located in a rear end of the first body towards a rear end of the linear portion; a second connection portion provided in each of the upper and lower ends of the second body and configured to movably couple the second body to the base while being located in a rear end of the first connection portion; an extended body extended towards a front end of the first body from the second body to cover the slide through-hole and having the slide slit provided therein; and a projected body provided in the extended body and configured to define a space for accommodating a front end of the first body.

The slide slit penetrates the second body along a crossing direction with respect to the moving direction of the second body.

The attractive power supply unit may comprise a permanent magnet fixed to the second body or the base; and a conductive material fixed to the other one of the second body and base.

The drawer guide of claim 6, wherein the attractive power supply unit may comprise a first permanent magnet fixed to the second body to expose a magnetic pole of N-pole or S-pole; and a second permanent magnet fixed to the base to expose the other magnetic pole of the N-pole and the S-pole.

The attractive power supply unit may comprise a bar rotatably coupled to the base; and a bar spring provided to connect the bar and the base with each other, and the bar spring is configured to supply a force for pressing one end of the first transfer unit moved along the base slit to a rear end of the linear portion.

The base slit may further comprise a second curved portion upwardly or downwardly curved from a rear end of the linear portion.

The curved portion may be upwardly inclined from a front end of the linear portion and the second curved portion be downwardly inclined from the rear end of the linear portion.

The second transfer unit may comprise a transfer body secured to the operation body; and a transfer unit slit provided to penetrate the transfer body to provide a moving passage of the first transfer unit, and the transfer unit may comprise an inserting hole provided in a rear end of the transfer body; and an inclined portion connected with the inserting hole and downwardly from the inserting hole.

The attractive power supply unit comprise a bar rotatably coupled to the base; and a bar spring provided to connect the bar and the base with each other to supply an elastic force to the bar, and the bar spring may supply a power for moving the first transfer unit to the second curved portion the first transfer unit moved to the rear end of the linear portion.

In another aspect of the present disclosure, a laundry treatment apparatus comprises a cabinet comprising an introduction opening; a drawer provided in the cabinet; a tub provided in drawer and configured to hold water; a drum rotatably provided in the tub and configured to hold clothes; a drawer guide configured to connect the drawer and the cabinet with each other to facilitate the drawer to be withdrawn outside the cabinet via the introduction opening, wherein the drawer guide comprise a fixed body fixed to the cabinet or the drawer; an operation body that is withdrawable from the fixed body; base provided in the fixed body; a slit comprising a linear portion provided in parallel with the moving direction of the operation body; and a curved portion upwardly or downwardly extended from a front end of the linear portion located in a withdrawing direction of the operation body, the slit provided in the base; a first slide movably coupled to the base to be movable along the base; a second slide movable along the base and movable towards a rear end of the linear portion by the first slide; a slide slit provided to penetrate the second slide; a first transfer unit having one end movably coupled to the base slit and the other end inserted in the slide slit to penetrate the second slide; a second transfer unit provided in the operation body and detachably coupled to the first transfer unit, the second transfer unit configured to move the first transfer unit to the curved portion from the linear portion when the operation body is moved towards the withdrawing direction from the fixed body and the first transfer unit to the linear portion from the curved portion when the operation body is moved towards the inserting direction in the fixed body; a spring provided to connect the base and the first slide with each other and move the first slide towards a rear end of the linear portion wen the first transfer unit is moved to the linear portion from the curved portion; and an attractive power supply unit configured to supply a power to the second slide to move the second slide towards a rear end of the linear portion.

Advantageous Effects

Accordingly, the embodiments have following advantageous effects.

According to embodiments of the present disclosure, a drawer guide that is able to generate a force used in moving the drawer towards the inside of a cabinet, when a drawer is spontaneously moved a preset reference distance towards a cabinet a laundry treatment apparatus having the same.

Furthermore, the drawer guide that supplies a preset force to keep the inside of the cabinet in a pressed state so as to enable a drawer to be withdrawn from the cabinet only when a preset reference external force or more is applied to the drawer and a laundry treatment apparatus having the same.

Further scope of applicability of the present disclosure will become apparent from the detailed description given hereinafter. However, it should be understood that the detailed description and specific examples, while indicating preferred embodiments of the disclosure, are given by illustration only, since various changes and modifications within the spirit and scope of the disclosure will become apparent to those skilled in the art from this detailed description.

DETAILED DESCRIPTION

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. A singular representation may include a plural representation unless it represents a definitely different meaning from the context. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

A drawer guide 4 in accordance with the present disclosure may be broadly applied to not only electric appliances such as a laundry treatment apparatus and a refrigerator but also furniture such as a desk or a closet. Hereinafter, the drawer guide 5 in accordance with the present disclosure may be provided in the laundry treatment apparatus 100 to describe embodiments of the present disclosure.

Figure 1:
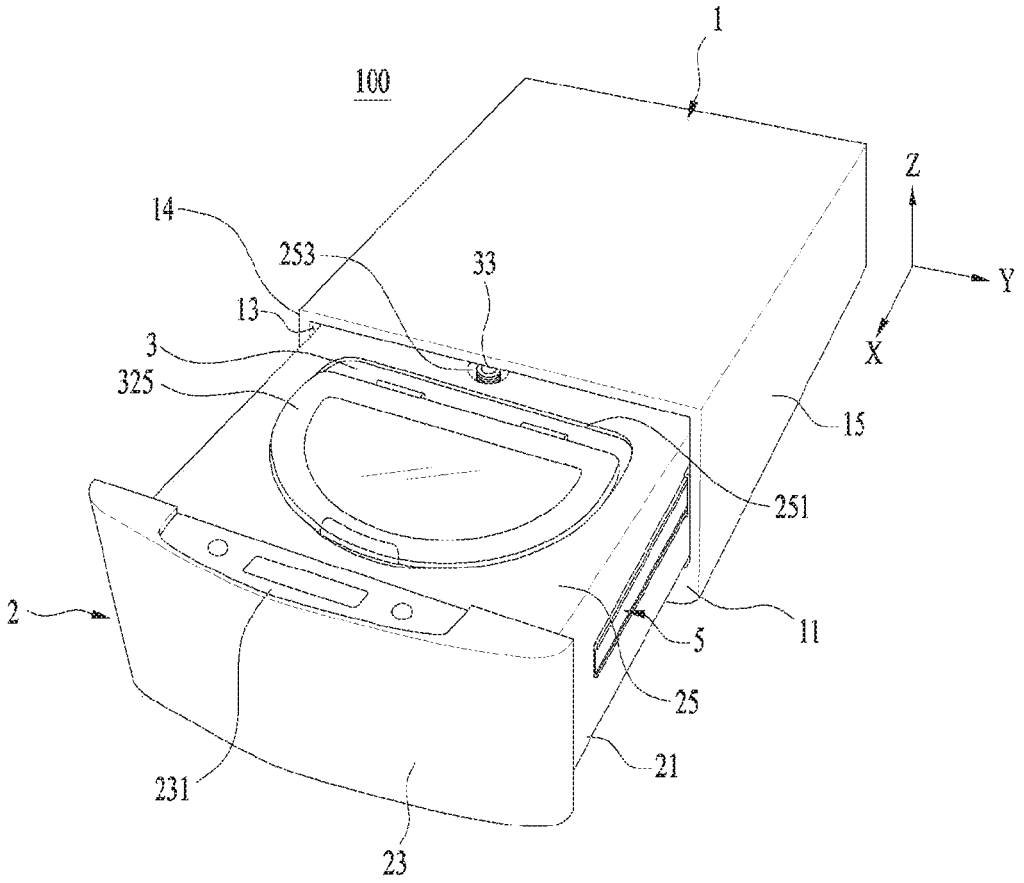
FIGS. 1 and 2 are diagrams illustrating one example of a drawer guide in accordance with the present disclosure and a laundry treatment apparatus having the drawer guide is a diagram illustrating an exterior design of a laundry treating apparatus.
Figure 2:
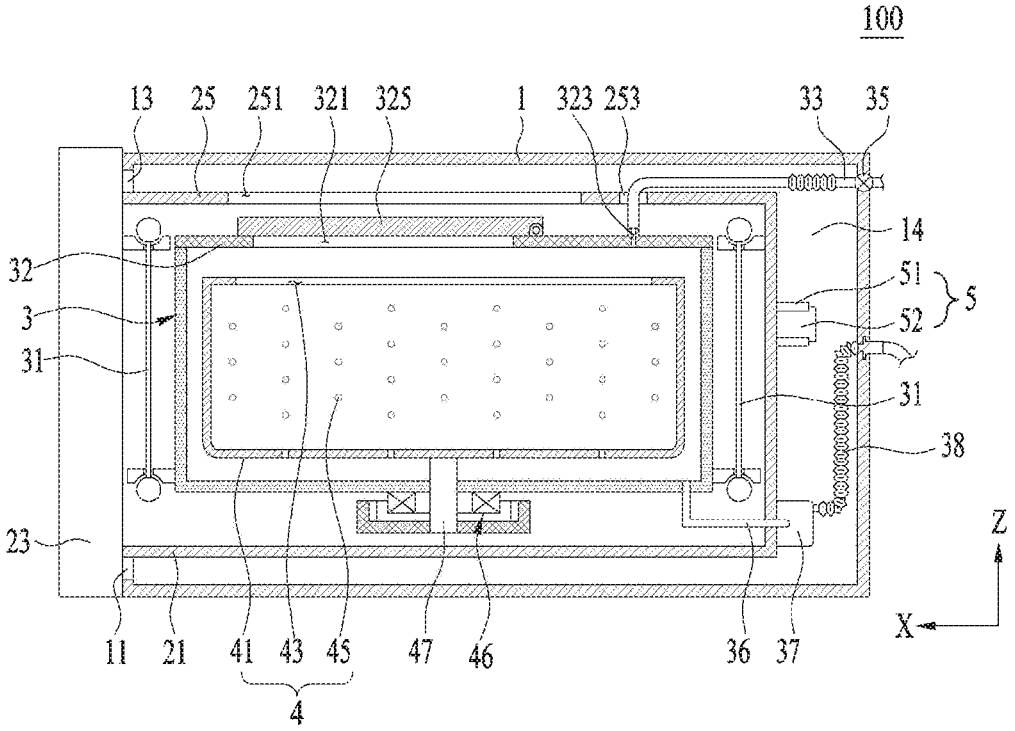

FIGS. 1 and 2 are diagrams illustrating one example of a drawer guide in accordance with the present disclosure and a laundry treatment apparatus having the drawer guide is a diagram illustrating an exterior design of a laundry treating apparatus. As shown in FIG. 1, the laundry treatment apparatus 100 includes a cabinet 1 having a front surface 11 in which a laundry introduction opening 13 is provided; a drawer 5 disposed in the cabinet 1; and a drawer guide 5 configured to facilitate the withdrawing of the drawer 2 outside the cabinet 1 via the introduction opening 13.

The drawer guide 5 may be provided in both lateral surfaces 14 and 15 of the cabinet 1 which face each other, respectively. In other words, the drawer guide 5 may include a first drawer guide provided in a first lateral surface 14 and a second drawer guide provided in a second lateral surface 15.

The drawer 2 may include a drawer body 21 disposed in the cabinet 1; and a drawer panel 23 configured to be located outside the cabinet. The drawer body 21 may be provided in any shapes that are inserted in the cabinet 1 via the introduction opening 13. FIG. 1 illustrates that the drawer body 21 is provided in a cube shape as one example. A top surface 25 (hereinafter, the drawer cover) has a first through-hole 251 and a second through-hole 253, of which functions will be described later.

The drawer panel 23 may be provided to keep a state of being exposed outside the cabinet 1 even when the drawer body 21 is completely inserted in the cabinet 1. The state where the drawer body 21 is completely inserted in the cabinet 1 may be defined as a state where the introduction opening 13 is closed by drawer panel 23.

The drawer panel 23 keeps the exposed state to the outside of the cabinet 1 and it is preferred that a control panel 231 is provided in the drawer panel 23. The control panel 231 may include an input unit configured to receive a control command from a user and a display unit configured to display information related with the control to the user.

As shown in FIG. 2, the drawer 2 may include a tub 3 provided in the drawer and configured to define a space for holding water; and a drum rotatably provided in the tub 3 and configured to define a space for holding clothes.

The tub 3 may be fixed to the drawer body 21 by a tub support portion 31 and includes an opening 321 formed in a top surface (32, hereinafter, a tub cover) to enable communication with the tub inside with the tub outside. The opening 321 is closable by a door 325 rotatably coupled to the top surface of the tub. In this instance, the door 325 may be located under the first through hole 251. That is to allow the door 325 to rotatably move from the top surface 31 of the tub towards the outside of the drawer 2.

The tub mentioned above may receive water via a water supply unit and discharge the water held in the tub 3 outside the cabinet.

The water supply unit may include a water supply pipe 33 provided to connect the tub 3 with the water supply source; and a water supply valve 35 provided to open and close the water supply pipe. In this instance, a water supply hole 323 may be provided in the tub cover 32 to draw the water supplied via the water supply pipe to the tub 3. The water supply pipe 33 may be provided as a corrugated pipe that is extendable towards a direction in which the drawer is withdrawn (X-direction).

The water discharge unit may include a water discharge pump 37 fixed to the drawer body 21; a first water discharge pipe 36 provided to connect the tub 3 with the water discharge pump; and a second water discharge pipe 38 provided to guide the water discharged from the water discharge pump outside the cabinet. The second water discharge pipe 38 may be configured to pass a higher point than the highest water level set in the tub and provided as a corrugated pipe that is extendable towards the direction of the withdrawing drawer.

The drum 4 may include a drum body 41 formed in a cylinder shape with an empty space; and a drum opening 43 provided in a top surface of the drum body and configured to draw the clothes loaded via the introduction opening 321 into the inside of the drum body. A plurality of communication holes 45 may be provided in a circumferential surface and a bottom surface of the drum body 41 to communicate the internal space of the drum with the internal space of the tub.

The drum body 41 may be rotatable by a drum drive unit 46 configured of a stator, a rotor and a shaft 47 provided to connect the rotor with the drum body while penetrating tub.

The drawer 2 having the above-noted structure may be coupled to the cabinet 1 via the drawer guides 5 provided in the first and second lateral surfaces 14 and 15 of the cabinet. The drawer guides provided in the first lateral surface 14 and the second lateral surface 15 of the cabinet, respectively, may have the same structure. Hereinafter, only the structure of the drawer guide 5 provided coupled to the first lateral surface 14, referring to FIGS. 3 through 5.

Figure 3:
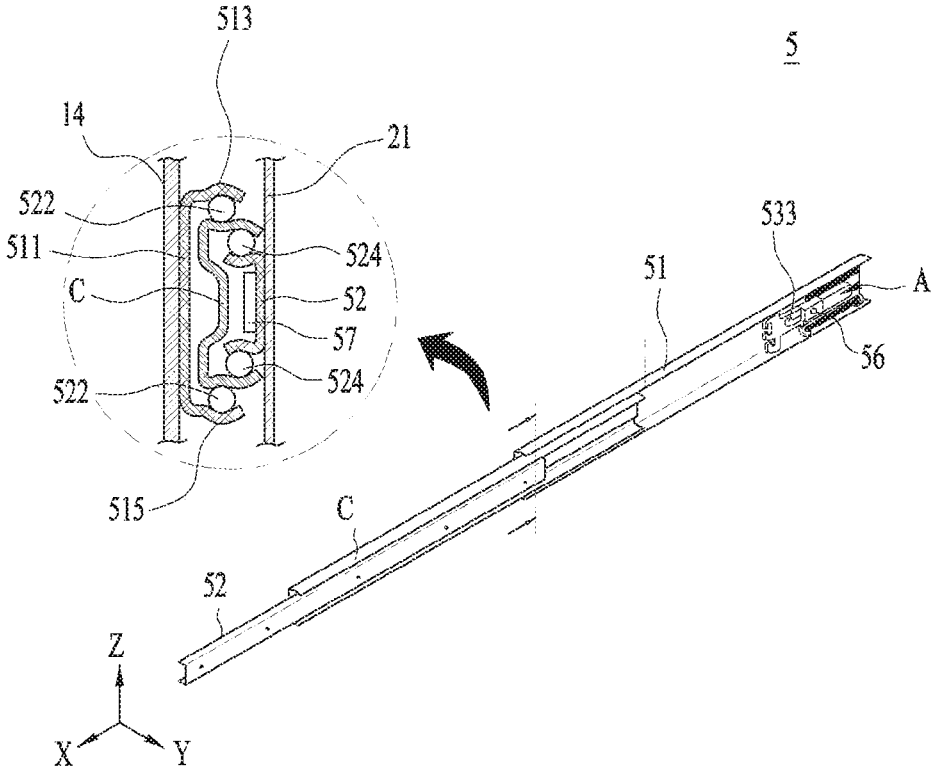
FIG. 3 is a diagram illustrating one example of the drawer guide.

As shown in FIG. 3, the drawer guide 5 in accordance with the present disclosure may include the fixed body 51 fixed to the cabinet or the drawer; a connection body C that is withdrawable towards the introduction opening 13 from the fixed body 51; an operation body 52 that is withdrawable from the connection body towards the introduction opening 13 (an X-axis direction) and coupled to the other one of the cabinet and the drawer; and a body control unit A provided in the fixed body 51 and configured to provide a power for moving the operation body 52 in a direction where the drawer is inserted (the X-axis direction) spontaneously.

Different from the example shown in FIG. 3, the drawer guide 5 in accordance with the present disclosure may include a fixed body 51 fixed to the cabinet or the drawer; an operation body 52 fixed to the other one of the cabinet and the drawer and provided to be withdrawable from the fixed body towards the introduction opening 13; and a body control unit A provided in the fixed body 51. For easy explanation of the present disclosure, the drawer guide including the fixed body 51, the connection body C, the operation body 52 and the body control unit A will be applied.

The fixed body 51 may include a first frame 511 provided along the direction in which the drawer is withdrawn (the X-axis direction); and a second frame 513 and a third frame 515 that are provided to face an upper and a lower end of the first frame 511 to provide a mounting space of the operation body 52.

The connection body C may be located in the mounting space and withdrawn along the X-axis direction from the fixed body 51. The operation body 52 may be withdrawn from the connection body C along the X-axis direction.

The connection body C may be formed in any shapes only if it is mounted in the mounting space. As shown in FIG. 3, the connection body C may include a first connection body frame; and second and third connection body frames that are projected towards the drawer (the Y-axis direction) from the top and lower ends of the first connection body.

The operation body 52 may be formed in any shapes only if it is able to be mounted in the mounting space defined by the three frames of the connection body. FIG. 3 illustrates that the operation body 52 includes a first operation body frame fixed to the drawer body 21; and second and third operation body frames that are projected towards the connection body C from upper and lower ends of the first operation body frame as one example.

The connection body C may move along the X-axis in a state of being coupled to the fixed body 51 by using a first bearing and the operation body 52 may move along the X-axis in a state of being coupled to the connection body C by using a second bearing 524.

The first bearings 522 may be provided in a space formed between the first frame 513 and the first connection body frame and a space formed between the second frame 515 and the second connection body frame, respectively. Similarly, the second bearings 524 may be provided in a space formed between the first connection body frame and the first operation body frame and a space formed between the second connection body and the second operation body frame, respectively.

Figure 4:
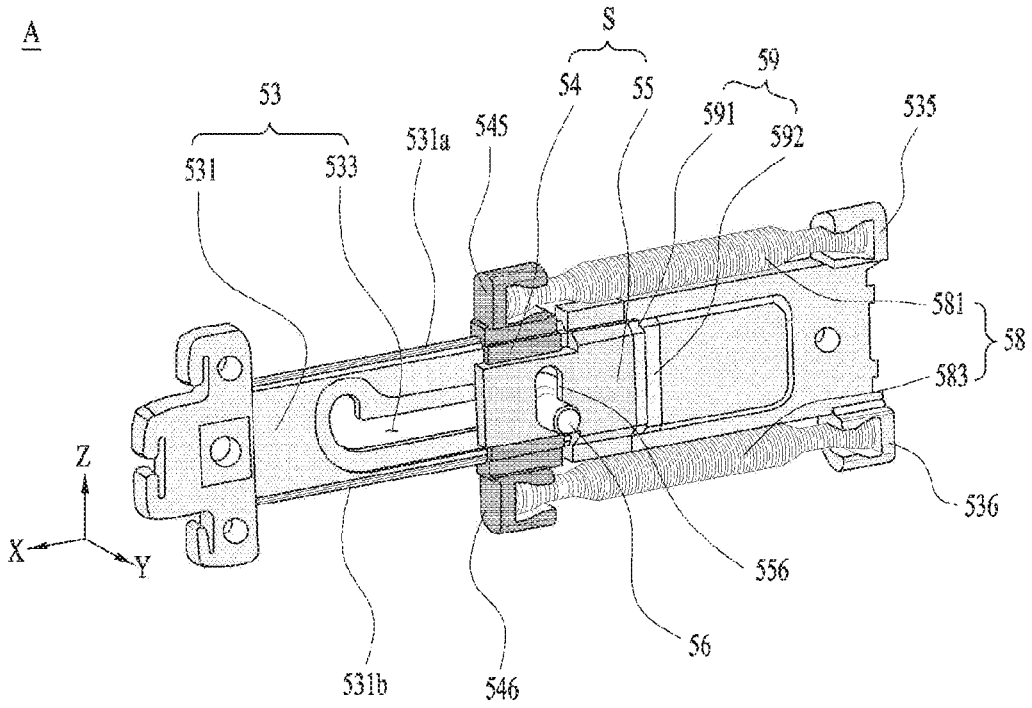
FIGS. 4 and 5 are a front perspective view and an exploded perspective view illustrating a first embodiment of a body control unit provided in the drawer guide.

The body control unit A provided in the drawer guide 5 may include one example of a structure shown in FIG. 4. In other words, the body control unit A may include a base 53 detachably secured to the fixed body 51 or integrally formed with the fixed body; a slide S secured to the base and configured to reciprocate along the direction in which the drawer is withdrawn; and a transfer unit 56 and 57 detachably coupled to the slide S along the position of the drawer 2.

The base 53 includes a base body 531 fixed to the fixed body 51; and a base slit 533 penetrating the base body. The length of the base slit 533 in parallel with the withdrawing direction of the drawer (the X-axis direction) is longer than the longitudinal length of the drawer (the Z-axis direction).

First and second rails 531*a* and 531*b* for providing moving passages of the slide S may be provided in upper and lower end of the base body 531, respectively. The first rail 531*a* may be projected from the upper end of the base body 531 upwardly (the Z-axis direction) and the second rail 531*b* may be projected from the lower end of the base body 531 downwardly (the Z-axis direction).

Figure 5:
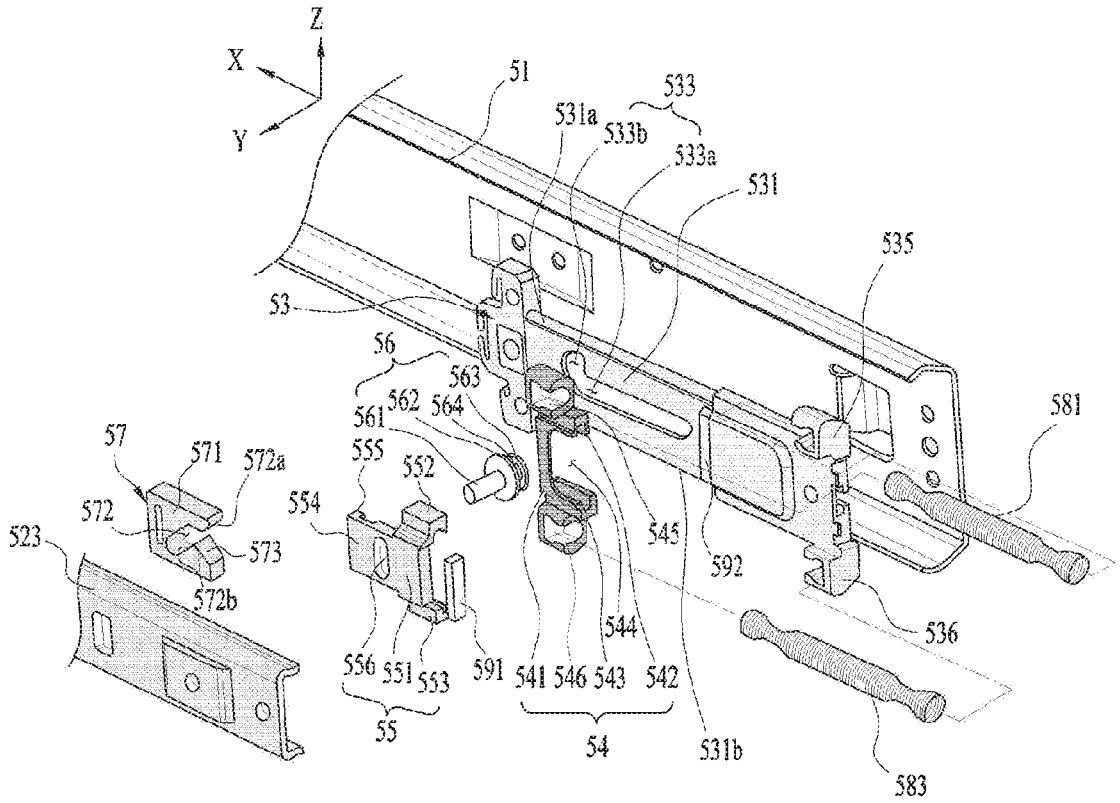

Referring to FIG. 5, the structure of the slit 533 will be described in detail. The base slit 533 may be provided as the means for providing the moving passage of the transfer unit 56 and 57 which will be described later. The base slit 533 may include a linear portion 533*a* provided along the same direction with the moving direction of the drawer 2, and a curved portion (533*b*, the first curved portion) provided in a front end of the linear portion. The first curved portion 533*b* may be upwardly inclined or downwardly inclined with respect to the front end of the linear portion 533*a*. FIG. 5 illustrates the former case as one example. The description that the linear portion 533*a* is provided along the same direction with the moving direction of the drawer 2 may mean that the linear portion 533*a* is provided in parallel with the moving direction of the drawer (the motion of the operation body) and that the it is inclined with respect to the moving direction of the drawer.

The slide S may include a first slide 54 and a second slide 55 that are coupled to the base 53 and movable along the base, in communication with each other. the fact that the first slide 54 and the second slide 55 are movable in communication with each other may mean that the second slide 55 is moved to a rear end of the linear portion by the first slide 54 when the first slide 54 is moved towards a rear end of the linear portion 533*a* (that is, moved towards the X-axis direction) and that the first slide 54 is moved towards the first curved portion by the second slide 55 when the second slide 55 is moved towards the first curved portion 533*b* (that is, moved towards the X-axis direction).

The first slide 54 includes a first body 541; and a first connection portion 542 and 543 provided to connect the first body 541 with the base body 531. The first connection portion may include a first rail accommodating area (542, the first body first rail accommodating area) provided to connect the first body 541 with the first rail 531*a* provided in the upper end of the base body; and a second rail accommodating area (543, a first body second rail accommodating area) provided to connect the first body 541 with the second rail 531*b* provided in a lower end of the base body.

The first rail accommodating area 542 may include an accommodation body provided in an upper end of the first body 541, with a short length than the first rail; and a groove provided in the accommodation body to insert the first rail therein. Similarly, the second rail accommodating area 542 may include an accommodation body provided in a lower end of the first body 541, with a shorter length than the length of the second rail 531*b*; and a groove provided in the accommodation body to insert the second rail therein. Accordingly, the first body 541 is able to move along the longitudinal direction of the base body 531 by the two rails 531*a* and 531*b* and the two rail accommodating areas 542 and 543.

The first rail accommodating rail 542 may be projected towards a direction in parallel with the longitudinal direction of the first rail from the upper end of the first body 541. The second rail accommodating area 543 may be projected towards a direction in parallel with the longitudinal direction of the second rail 531*b* from the lower end of the first body 541. In this instance, a slide through-hole 544 may be formed between the first rail accommodating area 542 and the second rail accommodating area.

The first slide 54 having the above-noted structure may be supplied the power needed in moving from the front area to the rear area of the base body 531 by using a spring 58 (the power for moving along the X-axis). One end of each spring 581 and 583 may be secured to the first body 541 and the other end may be provided as a tensile spring secured to the base body 531. The tensile spring mean a spring that is extended by an external force and then restitutes to have the original length when the external force is removed. FIG. 5 illustrates that the spring includes the first spring 581 and the second spring 583.

One end of the first spring 581 may be secured to a first first-spring securing area 535 provided in an upper end of the base body and the other end thereof may be secured to a second first-spring securing area 545 provided in an upper end of the first body 541 (that is, an upper end of the first rail accommodating area), One end of the second spring 583 may be secured to a first second-spring securing area 536 provided in a lower end of the base body and the other end thereof may be secured to the second second-spring securing area 546 provided in the lower end of the first body 541 (the lower end of the second rail accommodating area).

Considering the easy assembling of the springs 581 and 583, it is preferred that the spring securing areas 534, 536, 545 and 546 are formed in a cylinder shape having one surface that is open toward the width direction of the drawer.

Different from what is shown in the drawings, the first and second springs may be compression springs. The compression spring refers to all types of springs that have a structure for getting shorter by an external force and returning to its original length when the external force is removed. In this instance, the first first-spring securing area 535 and the first second-spring securing area 536 may be provided in a front area of the base body 531. The first and second springs 581 and 583 may be compressed when the first slide 54 is moved towards the front of the base body (that is the X-axis direction).

The second slide 55 may include a second body 551; a second connection portion 552 and 553 provided to movably connect the second body 551 to the base body 531; and a body coupling portion 554 and 555 provided to connect the second body 551 with the first body 541.

The second body 551 may be supplied the power needed in moving by the first body 541, when moving towards the rear of the base body 531 and the transfer unit 56 and 57 which will be described later, when moving towards the front of the base body 531. The first body 541 may move towards the front area of the base body 531 together with the second body 541, when the second body 551 moves towards the front area of the base body 531. For that, the second body 551 may be located in a rear end of the first body 541 (one surface of the first body towards the rear end of the linear portion) as one example.

The second connection portion may include a first second-body rail accommodating area 552 provided in an upper end of the second body 551, with a shorter length than the first rail 531*a*, and coupled to the first rail 531*a*; and a second second-body rail accommodating area 553 provided in a lower end of the second body 551, with a shorter length than the second rail 531*b*, and coupled to the second rail 531*b*.

The first second-body rail accommodating area 552 may include an accommodation body that is shorter than the first rail 531*a*; and a groove provided in the accommodation body and configured to insert the first rail 531*a* therein. The second second-body rail accommodating area 553 may include an accommodation body shorter than the second rail 531*b*; and a groove provided in the accommodation body and configured to insert the second rail therein.

In addition, the first second-body rail accommodating area 552 may be located in a rear portion of the first first-body rail accommodating area 542 and the second second-body rail accommodating area 553 may be located in a rear portion of the second first-body rail accommodating area 543.

The body coupling portion may include an extended body 554 extended towards a front end of the first body 541 (one surface of the first body towards the introduction opening); and a projected body 555 projected towards the base body 531 from the extended body 554. The extended body 554 may be provided to cover the slide through-hole 544 provided in the first slide. In this instance, the first body 541 may be coupled to the second body 551 by being inserted in the space defined between the projected body 555 and the second connection area 552 and 553.

The slide S having the above-noted structure may reciprocate along the longitudinal direction (the X-axis direction) of the base by 531 by the transfer unit 56 and 57. As shown in FIG. 5, the transfer unit may include a first transfer unit 56 that is movable along the base slit 533, and a second transfer unit 57 that is provided in the operation body 52 and movable together with the drawer 2.

One end of the first transfer unit 56 may be secured to the base 53 to be movable along the base slit 533 and the other end (the free end) thereof may be provided as a connection bar 561 connected with the second slide 55. A first projection 562 and a second projection 563 may be provided in a circumferential surface of the connection bar 561, spaced a preset distance apart from each other.

Figure 6:
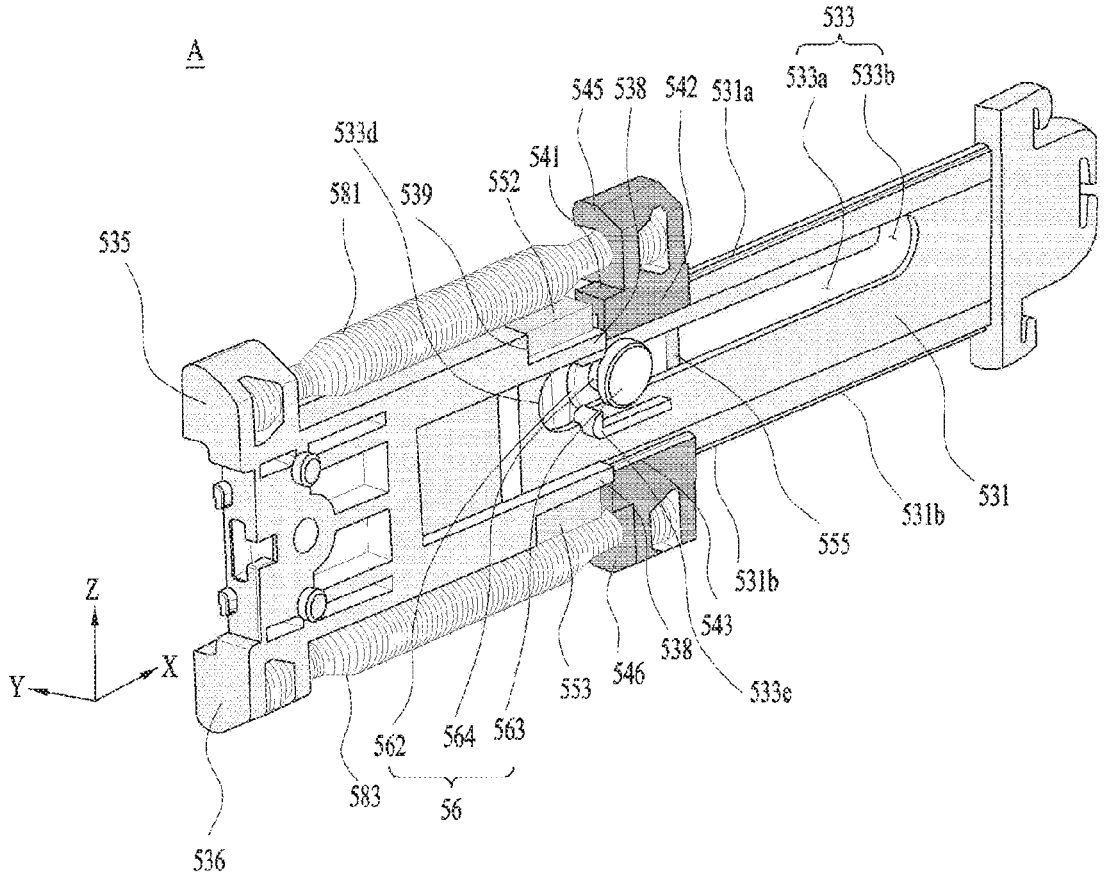
FIG. 6 is a rear perspective view of the body control unit'

As shown in FIG. 6, the base slit 533 may be inserted in a base slit coupling groove 564 formed between the first and second projections 562 and 563 such that the connection bar 561 can move along the moving passage provided by the base slit 533. The projections 562 and 563 capable of realizing the above-noted function may be provided in other shapes from the shape shown in the drawing.

To couple the first transfer unit 56 to the base slit 533, a first transfer unit inserting hole 533*d* having a larger diameter than a diameter of the second projection 563 may be further provided in a rear end of the linear portion 533*a*.

In addition, a first transfer unit stopper 533*d* may be further provided in the base body 531 to prevent the first transfer unit 56 coupled to the base slit 533 from being moved to the first transfer unit inserting hole 533*d* from the linear portion 533*a*. The first transfer unit stopper 533*e* may be formed in a shape of a projection upwardly inclined as getting farther from the first transfer unit inserting hole 533*d*.

As shown in FIG. 4, the free end of the connection is exposed outside the second slide 55 after penetrating the slide through-hole 544 provided in the first slide and the slide slit 556 provided in the second slide 55. The slide slit 556 may penetrate the first body 551 or the extended body 554. The drawing shows that the slide slit 556 penetrates the extended body 554 as one example.

As shown in FIG. 5, the slide slit 556 has the length crossing the linear portion 533*a* of the base slit (or the direction crossing the linear portion) that is longer than the length in parallel with the linear portion (the X-axis direction length). When the first transfer unit 6 is moved to the first curved portion 533*b* from the linear portion 533*a* or to the linear portion 533*a* from the first curved portion 533*b*, the free end of the connection bar 561 will move along the direction crossing the linear portion.

The slide through-hole 544 may have one open surface that is open towards the rear end of the linear portion 533*a*. That is to prevent the horizontal motion of the connection bar 561 from being restricted by the slide through-hole 544.

The first transfer unit 56 may be movable along the base slit 533 by the second transfer unit 57 provided in the operation body 52. The second transfer unit 57 may be provided as means for moving the connection bar 561 to the curved portion 533*b* from the linear portion 533*a*, when the operation body 52 is moved towards the direction in which it is withdrawn from the fixed body 51 (that is, towards the direction in which the drawer is withdrawn from the cabinet), and moving the connection bar 561 to the linear portion 533*a* from the curved portion 533*b*, when the operation body 52 is moved towards the direction in which the operation body 52 is inserted in the fixed body 51.

The second transfer unit 57 may be coupled to the free end of the connection bar 561, when the operation body 52 is inserted in the fixed body 51, and separated from the free end of the connection bar 561, when the connection bar 561 is inserted in the first curved portion 533*b* during the process of withdrawing the operation body 52 from the fixed body 51.

For that, the second transfer unit 57 may include a transfer body 571 secured to the operation body 52; and a transfer unit slit 572 penetrating the transfer body and providing a passage of the moving connection bar 561. The transfer slit 572 may include an inserting hole 572*a* provided in a rear end of the transfer body 571; and an inclined portion 572*b* connected with the inserting hole 572*a*.

The inclination direction of the inclined portion 572*b* becomes different based on the inclined direction of the first curved portion 533*b* provided in the base slit 533. In other words, when the first curved portion 533*b* is upwardly inclined towards the moving direction of the withdrawn drawer from the front end of the linear portion 533*a* as shown in FIG. 5, the inclined portion 572*b* has to be downwardly inclined from the inserting hole 572*a*. In this case, the second transfer unit 57 is able to move the connection bar 561 from the linear portion 533*a* to the first curved portion 533*b* and from the first curved portion 533*b* to the linear portion 533*a*.

With the same reason, when the first curved portion 533*b* is downwardly inclined from the front end of the linear portion 533*a*, the inclined portion 572*b* has to be upwardly inclined from the inserting hole 572*a*. A connection bar guide 573 may be further provided to guide the free end of the connection bar 561 to the inserting hole 572*a*.

A stopper for restricting the moving distance of the slide S when the slide S is moved towards the rear end of the linear portion 533*a* may be further provided in the base body 531. As shown in FIG. 6 as one example, the stopper includes a first stopper 538 for restricting the moving distance of the first slide 54; and a second stopper 539 for restricting the moving distance of the second slide 55.

The first stopper 538 may be provided in an upper end or lower end of the rear surface composing the base body 531 and the second stopper 539 may be at least one or more of the upper and lower ends of the base body 531.

The second stopper 539 may be located behind the first stopper 538 and the distance between the first and second stoppers 538 and 539 may be longer than the length of the second connection portion 552 and 553 (the X-axis direction length). That is to allow the second slide 55 to move towards the second stopper 539, even when the motion of the first slide 54 is restricted by the first stopper 538.

The drawer guide 5 having the above-noted structure may realize an effect of moving the drawer 2 into the cabinet 1 spontaneously when the drawer 2 is moved to a preset coupling position (a position in which the second transfer unit is coupled to the first transfer unit) towards the inside of the cabinet 1.

The body control unit A may further include an attractive power supply unit 59 configured to supply a power needed in moving the second slide 55 towards the rear end of the linear portion 533*a* or the power for keeping a state where the second slide 55 is pressed towards the rear end of the linear portion 533*a*.

As shown in FIG. 5 as one example, the attractive power supply unit 59 may include a permanent magnet 591 fixed to the second body 551; and a magnetic material 592 fixed to a position towards the direction in which the permanent magnet 591 is located in the space defined by the base body 531. Different from what is shown in the drawing, the magnetic material 592 may be fixed to the second body 551 and the permanent magnet 591 may be fixed to the base body 531.

Accordingly, the power that keeps the pressed state of the drawer 2 towards the inside of the cabinet 1 to the drawer 2 may be continuously supplied to the drawer 2 such that an effect can be realized that the drawer 2 may be withdrawn from the cabinet 1 only if a preset reference external force or more is applied to the drawer 2.

Different from what is shown in FIG. 5, the attractive power supply unit 59 may include a permanent magnet 591 fixed to the second body 551; and a permanent magnet fixed to the base body 531. In this instance, the two permanent magnets have to be arranged with different poles facing each other.

The permanent magnet provided in the attractive power supply unit 59 mentioned above may be replaced by electromagnets. In this instance, considering the easy current supply, it is preferred that the electromagnet is fixed to the base body 531. In other words, the attractive power supply unit may include a magnetic material or permanent magnet fixed to the second body; and an electromagnet fixed to the base body.

The attractive power supply unit 95 including the permanent magnet 591 and the magnetic material 592, the two permanent magnets, the permanent magnet and the electromagnet, and the magnetic material and the electromagnet may be configured to supply the attractive power to the second slide 55 continuously or once the second slide 55 is moved the preset reference distance along the linear portion 533*a*.

When using the permanent magnet having a high magnetic power, the attractive power supply unit 59 is able to supply the attractive power to the second slide 55 even when the second slide 55 is fixed to a fixed position, because the first transfer 54 is located in the first curved portion 533*b*. In this instance, the slide S may be supplied both the restoring force of the spring 581 and 583 and the attractive power of the attractive power of the attractive power supply unit 99, such that the heavy drawer 2 may be moved into the cabinet 1 easily.

Meanwhile, when the permanent magnet provided in the attractive power supply unit 59 has a relatively small magnetic force, the attractive power supply unit 59, the attractive power supply unit 59 may supply the power for moving the slide 55 towards the rear end of the linear portion 533*a* once moved the reference distance along the linear portion 533*a*.

The reference distance may be set as a point that is corresponding to ⅔ of the length of the linear portion 533*a* with respect to the front end of the linear portion 533*a* (that is, the point that is located within ⅓ of the linear portion with respect to the rear end of the linear portion). The reference distance may be equal to the position of the first stopper 538 or it may be located in front of the first stopper 538. Or, the reference distance may be set as a point located between the first and second stoppers 538 and 539.

When the reference distance is set as the point in front of the first stopper 538, the period in which the first slide is supplied the power by the spring 581 and 583 may be overlapped with the period in which the second slide 55 is supplied the power by the attractive power supply unit 59. In other words, the period in which the second slide 55 is supplied the power by the first slide 54 may be overlapped with the period in which the second slide 54 is supplied the power by the attractive power supply unit 59. In this instance, it is effective to move the heavy drawer from the cabinet.

When the reference distance is set as the same position with the position of the first stopper 538 or the position located between the first and second stoppers 538 and 539, the period in the second slide 55 is supplied the power by the first slide 54 may not be overlapped with the period in which it is supplied the power by the attractive power supply unit 59.

When first slide 54 contacts with the first stopper 538 whatever the reference distance is set as, the second slide 55 is moved to the second stopper 539 only by the attractive power supplied by the attractive power supply unit 59 to keep the contact with the second state or the pressed state towards the second stopper 539.

Accordingly, when the drawer 2 is inserted in the cabinet 1, the attractive power supply unit 59 may be employed as the means for generating the power (e.g., a pre-load) that prevents the drawer 2 from being withdraw from the cabinet.

The spring 581 583 may be designed to have a length displacement of 0 when the first slide 54 contacts with the first stopper 538 or keep the extended state even when the first slide 54 contacts with the first stopper 538. In the latter case, the pre-load can be set to be larger advantageously.

Hereinafter, referring to FIGS. 7A-7C, the operation process of the drawer guide 5 having the above-noted structure will be described.

Figure 7A:
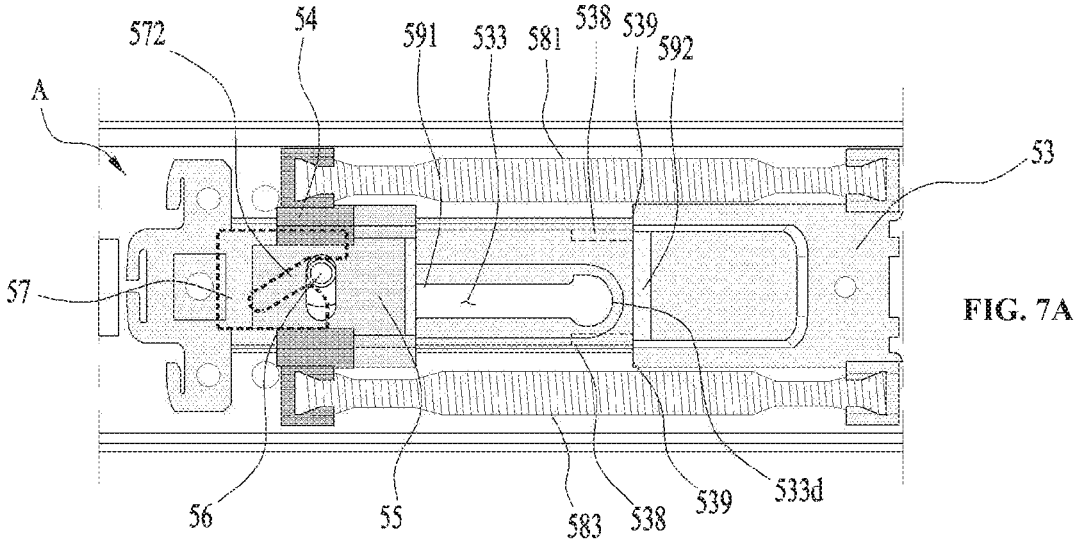
FIGS. 7A-7C are diagrams illustrating one example of an operation process of the body control unit shown in FIG. 4.
Figure 7B:
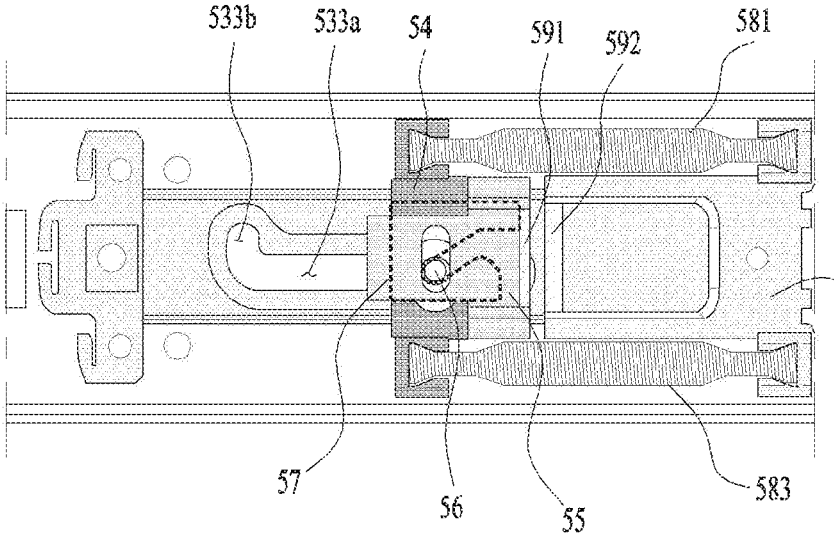

FIG. 7A illustrates that the second transfer unit 57 is coupled to the first transfer unit 56 once the drawer 2 is moved to the coupling position into the cabinet 1 by the external force applied by the user. FIG. 7B illustrates that the drawer 2 is moved the reference distance into the cabinet 1 by the spring 581 and 583. FIG. 7C illustrates that the attractive power supply unit 59 presses the first transfer unit 56 and the second slide 55 towards the direction in which the second stopper 539 is located.

As shown in FIG. 7A, when the user pushes the drawer 2 into the cabinet 1, the connection body C and the operation body 52 that are secured to the drawer may be moved behind the fixed body 51 in which the body control unit A is located. In this process, the second transfer unit 57 secured to the operation body 52 may be coupled to the first transfer unit 56.

Once the first transfer unit 56 is coupled to the second transfer unit 57, the transfer unit slit 572 provided in the second transfer unit 57 may move the first transfer unit 56 to the linear portion 533*a* from the first curved portion 533*b*. As shown in FIG. 7B, the first transfer unit 56 is moved to the linear portion 533*a* from the first curved portion 533*b* and then the first slide 54 is moved even to the first stopper 538 by the spring 581 and 583.

The second slide 55 located between the first slide 54 and the first stopper 538 may be moved by the first slide 54 and the first transfer unit 56 may be moved by the second slide 55 and the second transfer unit 57 may be moved by the first transfer unit 56 towards the position of the first stopper 538.

Figure 7C:
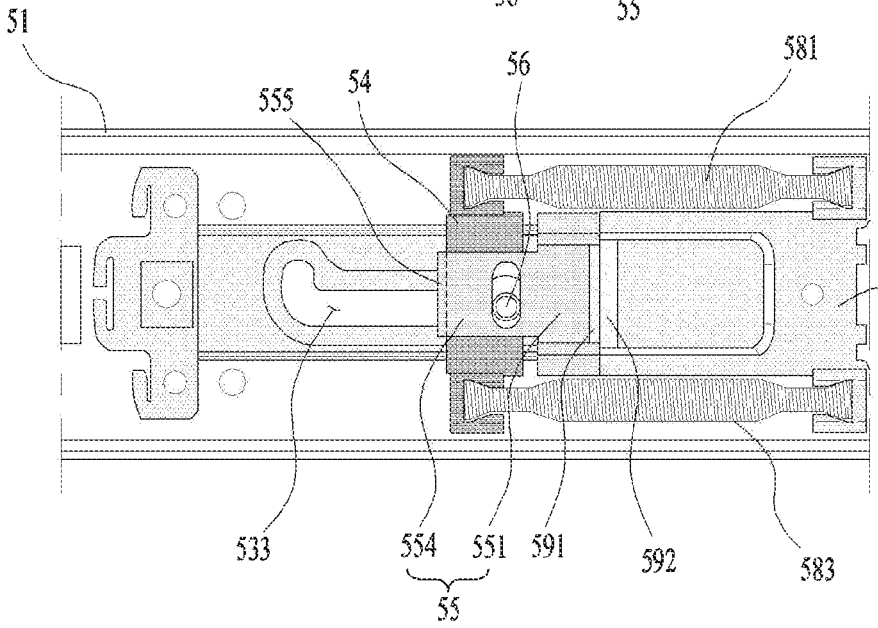

When the first slide 54 contacts with the first stopper 538, as shown in FIG. 7C the second slide 55 is pressed in the direction in which the second stopper 539 is located by the attractive power supply unit 59. The fact that the second slide 55 is pressed in the direction towards the second stopper 539 may mean that the second slide 55 is moved until it contacts with the second stopper 539 and also that it is supplied the attractive power toward the second stopper 539 by the attractive power supply unit 59.

The first and second slides 54 and 55 are connected with each other via the body coupling unit 554 and 555. When the first slide 54 contacts with the first stopper 538, the second slide 55 has to also stop the movement.

However, the tolerance reflected in the design and generated in the actual manufacturing process of the slides are likely to move the second slide 55 towards the second stopper 539 even after the first slide 54 is stopped. Once the second slide 55 is pressed in the direction towards the second stopper 539, the first transfer unit 56 connected with the second slide 55, the second transfer unit 57 coupled to the first transfer unit and the operation body 52 secured to the second transfer unit 57 may be pressure towards the second stopper 539 such that the present disclosure cam provide the pre-load to the drawer 2.

Meanwhile, the spring 581 and 583 may be provided to actuate the pre-load to the first slide 54. The spring 581 and 583 may supply a less amount of the power to the first slide 54 as the first slide 54 becomes closer to the first stopper 538. While, the attractive power supply unit 59 may supply a more power to the second slide 55 as the first slide 54 becomes closer to the first stopper 538. Accordingly, when the spring 581 and 583 is provided to apply the pre-load to the first slide 54, the power supplied to the first slide by the attractive power supply unit and the power supplied to the first slide by the spring may overlapped with each other to increase the pre-load supplied to the drawer in a state of FIG. 7C.

When the user withdraws the drawer from the cabinet 1 in the state of FIG. 7C, the first transfer unit 56 is moved towards the first curved portion 533*b* along the linear portion 533*a*. In this process, the second slide 55 may be moved by the first transfer unit 56 and the first slide 54 may be moved by the second slide 55 to the position in front of the base body 53.

When the first transfer unit 56 is inserted in the first curved portion 533*b*, the second transfer unit 57 is separated from the first transfer unit 56 and the spring 581 and 583 is in an extended state. The first transfer unit 56, the first slide 54 and the second slide 55 may be secured to the base body 531 (see FIG. 7A).

Figure 8:
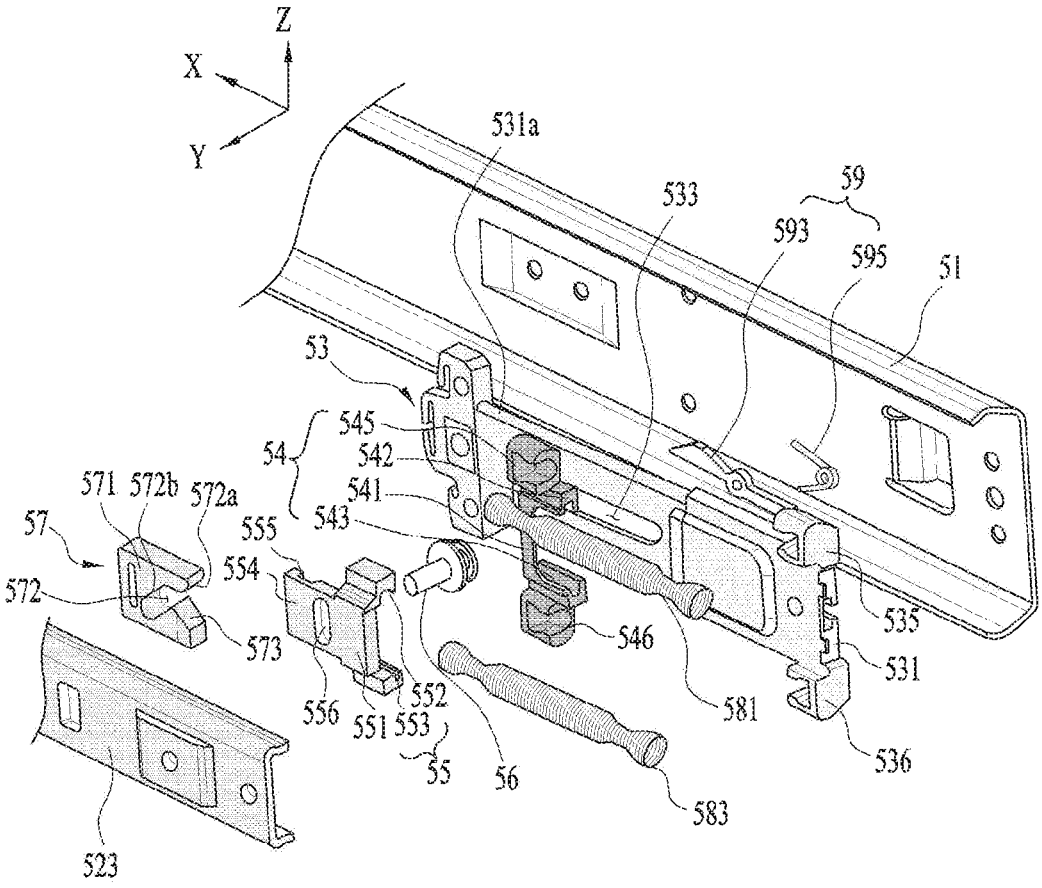
FIGS. 8 and 9 are diagrams illustrating a second embodiment of the body control unit in accordance with the present disclosure.
Figure 9:
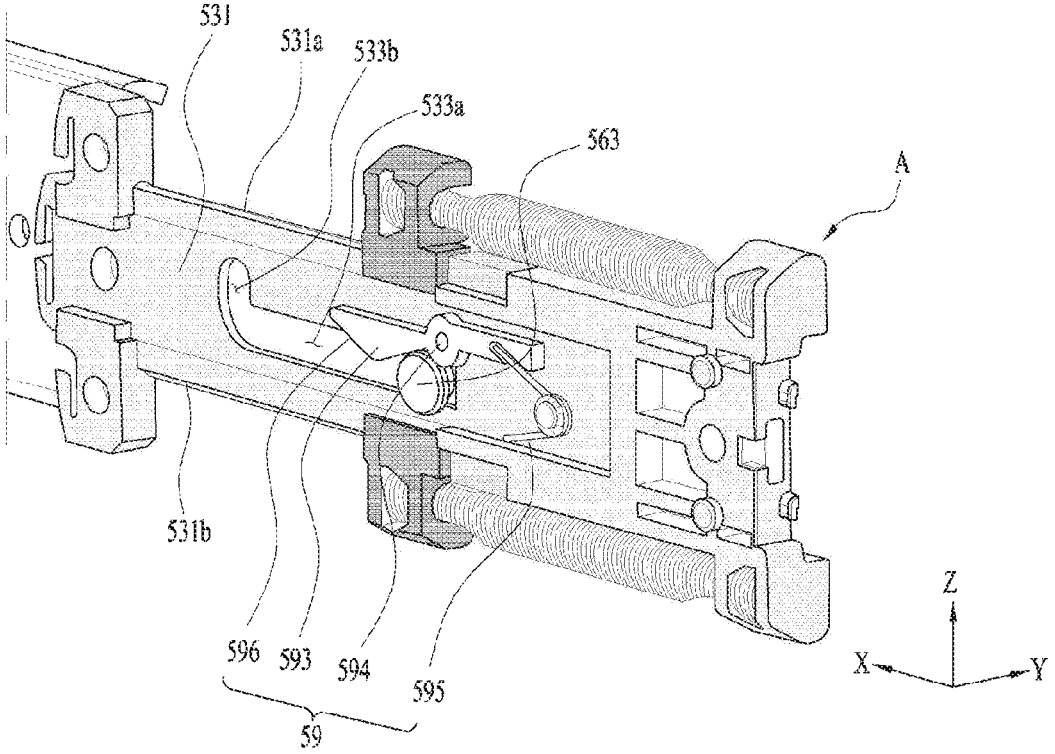

FIGS. 8 and 9 illustrate a second embodiment of the drawer guide 5. The present embodiment is equal to the drawer guide 5 mentioned in references to FIGS. 1 through 7, except the structure of the attractive power supply unit 59. Hereinafter, the structure of the attractive power supply unit 59 will be described in detail for easy explanation.

As shown in FIG. 9, the attractive power supply unit 59 in accordance with the present embodiment may include a bar 593 provided between the base 53 and the fixed body 51; a shaft 594 forming a rotational center of the bar 593; and a bar spring 595 provided to supply an elastic power to the bar 593.

The shaft 594 may be provided in the base 53 or the fixed body 51. As shown in FIG. 9 as one example the shaft 594 is provided in a rear surface of the base body 531 (that is, one surface of the base body towards the fixed body).

The bar 593 may be rotatably coupled to the base body 531 via the shaft 594. One end of the bar 593 may be projected towards a front area of the base body 531 and the other end thereof is projected towards a rear area of the base body 531.

A free end of the bar 593 (the area projected towards the front area of the base body 531 has to be located higher than the linear portion 533*a*. also, a free end of the bar 593 has to be located between the first curved portion 533*b* and a rear end of the linear portion 533*a*.

One end of the bar spring 595 may be secured to the bar 593 projected towards a rear area of the base body 531 and the other end thereof may be secured to the base body 531. The bar spring 595 is provided to apply a force for rotating the free end of the bar towards the linear portion 533*a*.

Moreover, a bar inclined surface 596 may be further provided in the free end of the bar 593 and the bar inclined surface 596 may be downwardly inclined as coming closer to the shaft 594. That is to prevent the bar 593 from interfering in the first transfer unit 56 moving to the rear end of the linear portion 533*a* along the linear portion 533*a*.

The reference distance preset by the body control unit A for the attractive power supply unit 59 to apply the power to the second slide 55 may be set as a distance from the front end of the linear portion 533*a* to the free end of the bar 593.

When the first transfer unit 56 is moved the reference distance, the second projection 563 provided in the first transfer unit may press the bar inclined surface in a clockwise direction. Once the second projection 563 passes the bar inclined surface 596, the free end of the bar 593 moves the second projection 563 to the rear end of the linear portion 533*a* while being rotated in a counter-clockwise direction by the bar spring 595.

Figure 10:
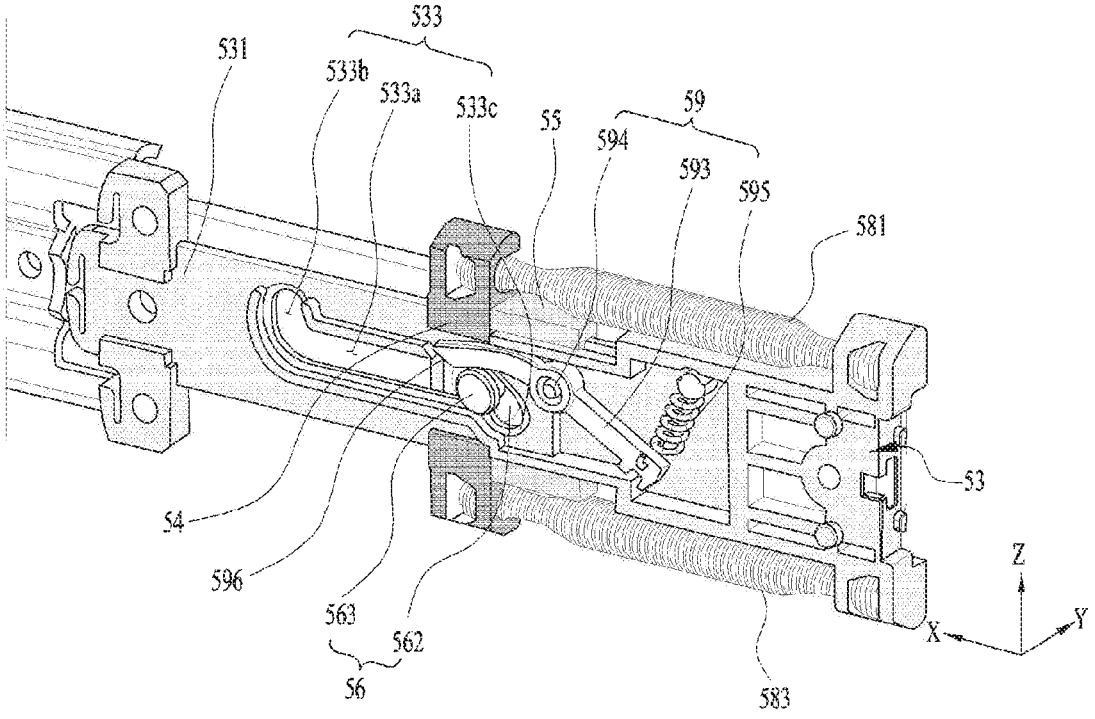
FIG. 10 is a diagram illustrating a body control unit in accordance with the present disclosure.

FIGS. 10 and 11 illustrate a third embodiment of the drawer guide 5. This embodiment is equal to the embodiment of FIG. 9, except the shape of the base slit 533 and the shape of the bar spring 595.

As shown in FIG. 10, the base slit 533 provided in the drawer guide in accordance with the present embodiment includes a linear portion 533*a*; a first curved portion 533*b* upwardly or downwardly inclined towards the withdrawing direction of the drawer from the front end of the linear portion 533*a*; and a second curved portion 533*c* extended from a rear end of the linear portion and inclined in the reverse direction of the inclination of the first curved portion 533*b*.

Specifically, in case the first curved portion 533*b* is upwardly inclined from the front end of the linear portion 533*a* (see FIG. 10), the second curved portion 533*c* has to be downwardly inclined from the rear end of the linear portion 533*a*.

However, in case the first curved portion 533*b* is downwardly inclined towards a direction which is getting farther from the front end of the linear portion 533*a*, the second curved portion 533*c* has to be upwardly inclined from the rear end of the linear portion 533*a*. In this instance, the inclination direction of the inclined portion 572*b* provided in the second transfer unit 57 has to be corrected. The reason why the inclination direction has to be corrected and the inclination direction are mentioned above and detail description thereof will be omitted accordingly.

One end of the bar spring 595 may be secured to the bar 593 and the other end thereof may be provided as a tensile spring secured to the base body 531.

Hereinafter, the operation process of the drawer guide 5 in accordance with the present embodiment will be described, referring to FIGS. 11A-11C.

Figure 11A:
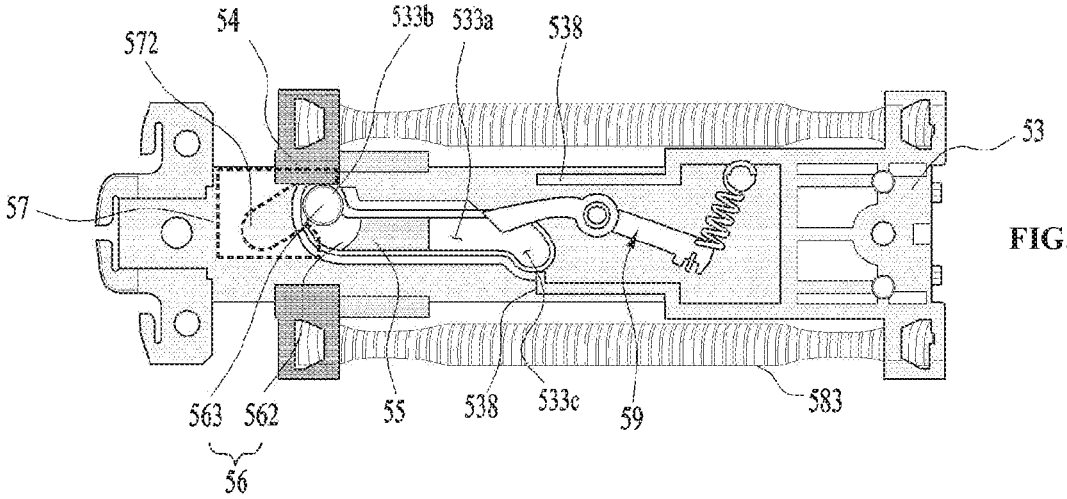
FIGS. 11A-11C are diagrams illustrating one example of an operation process of the body control unit shown in FIG. 10.
Figure 11B:
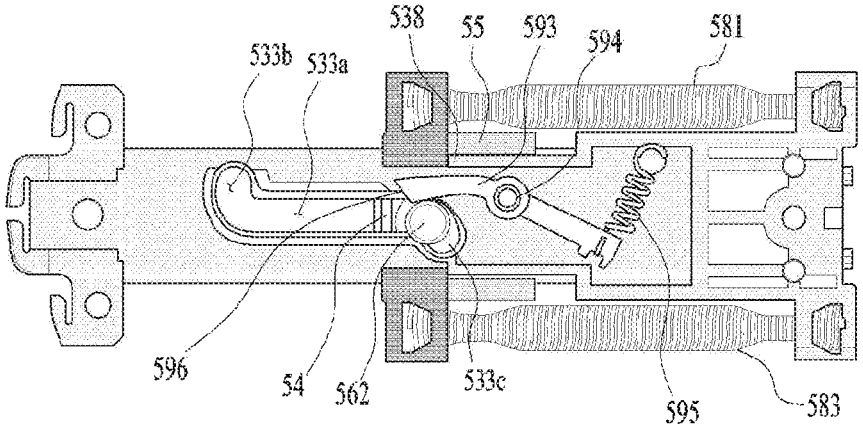

FIG. 11A illustrates the moment when the second transfer unit 57 is coupled to the first transfer unit 56 after the drawer 2 is moved to the coupling position towards the inside of the cabinet 1. FIG. 11B illustrates that the drawer 2 is moved into the cabinet 1 by the spring 581 and 583. FIG. 11C illustrates that the attractive power supply unit 59 moves the first transfer unit 56 to the second curved portion 533*c*.

As shown in FIG. 11A, when the user pushes the drawer 2 into the cabinet 1, the connection body C and the operation body that are secured to the drawer may be moved behind the fixed body 51 where the body control unit A is located. During this process, the second transfer unit 57 secured to the operation body 52 is coupled to the first transfer unit 56.

Once the second transfer unit 57 is coupled to the first transfer unit 56, the transfer unit slit 572 provided in the second transfer unit may move the first transfer unit 56 to the linear portion 533*a* from the first curved portion 533*b*. As shown in FIG. 11B, the first transfer unit 56 and then the first slide 54 is moved to the first stopper 538 by the spring 581 and 583.

The second slide located between the first slide 54 and the first stopper 538 and the first transfer unit 56 may be moved to the position of first stopper 538 (the reference position) by the first slide 54 and the second slide 55, respectively.

When the first slide 54 reaches the first stopper 538, the second projection 563 of the first transfer unit may rotate the bar 593 in the clockwise direction by pressing the bar inclined surface 596.

However, once the second projection 563 penetrates the bar inclined surface 596, the free end of the bar 593 presses the second projection 563 towards the second curved portion 533*c* while being rotated in the counter-clockwise direction by the bar spring 595.

The fact that the second projection 563 is pressed towards the second curved portion 533*c* may mean that the second projection 563 is moved until it contacts with the end of the second curved portion 533*c* (see FIG. 11C) and that the second projection 563 is supplied the force towards the last end of the second curved portion 533*c* by the attractive power supply unit 59.

According to the present embodiment, when the drawer 2 is completely inserted in the cabinet 1, the first transfer unit 56 may be located in the second curved portion 533*c* and then the pre-load for securing the drawer 2 in the cabinet 1 may be enhanced advantageously.

Figure 11C:
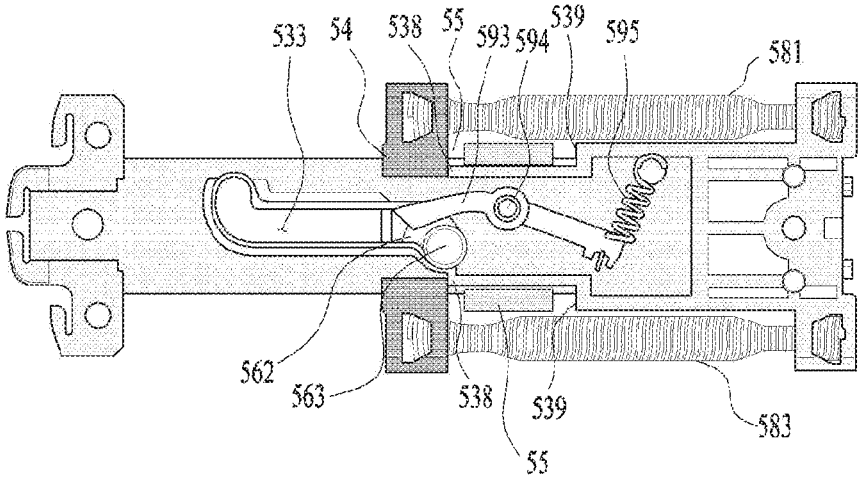

Meanwhile, when the user withdraws the drawer 2 from the cabinet 1 in the state of FIG. 11C, the second projection 563 provided in the first transfer unit 56 is moved to the linear portion 533*a* from the second curved portion 533*c* while rotating the bar 593 in the clock-wise direction.

The first transfer unit 56 is moved to the first curved portion 533*b* along the linear portion 533*a*. During this process, the second slide 55 is moved by the first transfer unit 56 and the first slide 54 is moved by the second slide 55. At this time, the slides are moved towards the front area of the base body 53.

Meanwhile, when the first transfer unit 56 is inserted in the first curved portion 533*b*, the second transfer unit 57 may be separated from the first transfer unit 56 and the spring 581 and 583 may become tensed. The first transfer unit 56, the first slide 54 and the second slide 55 may be secured to the base body 531 (see FIG. 11A).

The above-noted description is made based on the laundry treatment apparatus for washing clothes. The drawer guide in accordance with the present disclosure may be applied to the laundry treatment apparatus for drying clothes. In this instance, the drawer 2 may include a drying chamber (not shown) for providing a space for holding clothes; and a hot air supply unit (not shown) configured to supply heated air to the drying chamber.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A drawer guide comprising:

a fixed body;

an operation body that is withdrawable from the fixed body;

a base provided in the fixed body;

a base slit comprising a linear portion provided along the same direction with a moving direction of the operation body; and a curved portion upwardly or downwardly extended from a front end of the linear portion located in a withdrawing direction of the operation body, the base slit provided in the base;

a first slide movably coupled to the base to be movable along the base;

a second slide coupled to the base to be movable along the base and disposed at a rear side of the first slide to be moved rearwardly by the first slide;

a slide slit provided to penetrate the second slide;

a first transfer unit having one end movably coupled to the base slit and an opposite end inserted in the slide slit to penetrate the second slide;

a second transfer unit provided in the operation body and detachably coupled to the first transfer unit, the second transfer unit configured to move the first transfer unit to the curved portion from the linear portion when the operation body is moved towards the withdrawing direction from the fixed body and the first transfer unit to the linear portion from the curved portion when the operation body is moved towards an inserting direction in the fixed body;

a spring provided to connect the base and the first slide with each other and move the first slide towards a rear end of the linear portion when the first transfer unit is moved to the linear portion from the curved portion; and an attractive power supply unit configured to supply a power to the second slide to move the second slide relative to the first slide and towards the rear end of the linear portion.

2. The drawer guide of claim 1, wherein a section in which the second slide moves includes a first section in which the second slide is supplied power by the first slide and a second section in which the second slide is supplied the power by the attractive power supply unit, and wherein the first section and the second section are overlapped with each other.

3. The drawer guide of claim 1, wherein a section in which the second slide moves includes a first section in which the second slide is supplied power by the first slide and a second section in which the second slide is supplied the power by the attractive power supply unit, and wherein the first section and the second section are overlapped with each other.

4. The drawer guide of claim 1, wherein the attractive power supply unit is configured to supply an attractive power to the second slide at the moment when the second slide is moved a preset reference distance or more with respect to the front end of the linear portion.

5. The drawer guide of claim 1, wherein the first slide comprises:

a first body;

a first connection portion provided to movably couple the first body to the base, and wherein the second slide comprises:

a second body located in a rear area of the first body towards the rear end of the linear portion; and a second connection portion provided to movably couple the second body to the base and located in a rear area of the first connection portion, and wherein the slide slit penetrates the second body along a crossing direction with respect to a moving direction of the second body.

6. The drawer guide of claim 1, wherein the first slide comprises:

a first body;

a first connection portion provided in each of an upper end and a lower end of the first body and configured to movably couple the first body to the base; and a slide through-hole provided to penetrate the first body, and wherein the second slide comprises:

a second body located in a rear end of the first body towards the rear end of the linear portion;

a second connection portion provided in each an upper end and a lower end of the second body and configured to movably couple the second body to the base while being located in a rear end of the first connection portion;

an extended body extended towards a front end of the first body from the second body to cover the slide through-hole and having the slide slit provided therein; and a projected body provided in the extended body and configured to define a space for accommodating the front end of the first body.

7. The drawer guide of claim 6, wherein the slide slit penetrates the second body along a crossing direction with respect to a moving direction of the second body.

8. The drawer guide of claim 6, wherein the attractive power supply unit comprises:

a permanent magnet fixed to the second body or the base; and a conductive material fixed to the other one of the second body and base.

9. The drawer guide of claim 6, wherein the attractive power supply unit comprises:

a first permanent magnet fixed to the second body to expose a magnetic pole of N-pole or S-pole; and a second permanent magnet fixed to the base to expose the other magnetic pole of the N-pole and the S-pole.

10. The drawer guide of claim 6, wherein the attractive power supply unit comprises:

a bar rotatably coupled to the base; and a bar spring provided to connect the bar and the base with each other, and wherein the bar spring is configured to supply a force for pressing one end of the first transfer unit moved along the base slit to the rear end of the linear portion.

11. The drawer guide of claim 6, wherein the base slit further comprises:

a second curved portion upwardly or downwardly curved from the rear end of the linear portion.

12. The drawer guide of claim 11, wherein the curved portion is upwardly inclined from the front end of the linear portion and the second curved portion is downwardly inclined from the rear end of the linear portion.

13. The drawer guide of claim 12, wherein the second transfer unit comprises:

a transfer body secured to the operation body; and a transfer unit slit provided to penetrate the transfer body to provide a moving passage of the first transfer unit, and wherein the transfer unit slit comprises:

an inserting hole provided in a rear end of the transfer body; and an inclined portion connected with the inserting hole and downwardly from the inserting hole.

14. The drawer guide of claim 13, wherein the attractive power supply unit comprises:

a bar rotatably coupled to the base; and a bar spring provided to connect the bar and the base with each other to supply an elastic force to the bar, and wherein the bar spring supplies a power for moving the first transfer unit, which is located at the rear end of the linear portion, to the second curved portion.

15. A laundry treatment apparatus comprising:

a cabinet comprising an introduction opening;

a drawer provided in the cabinet;

a tub provided in drawer and configured to hold water;

a drum rotatably provided in the tub and configured to hold clothes;

a drawer guide configured to connect the drawer and the cabinet with each other to facilitate the drawer to be withdrawn outside the cabinet via the introduction opening, wherein the drawer guide comprises:

a fixed body fixed to the cabinet or the drawer;

an operation body that is withdrawable from the fixed body;

a base provided in the fixed body;

a base slit comprising a linear portion provided in parallel with a moving direction of the operation body; and a curved portion upwardly or downwardly extended from a front end of the linear portion located in a withdrawing direction of the operation body, the base slit provided in the base;

a first slide movably coupled to the base to be movable along the base;

a second slide movable along the base and movable towards a rear end of the linear portion by the first slide;

a slide slit provided to penetrate the second slide;

a first transfer unit having one end movably coupled to the base slit and an opposite end inserted in the slide slit to penetrate the second slide;

a second transfer unit provided in the operation body and detachably coupled to the first transfer unit, the second transfer unit configured to move the first transfer unit to the curved portion from the linear portion when the operation body is moved towards the withdrawing direction from the fixed body and the first transfer unit to the linear portion from the curved portion when the operation body is moved towards an inserting direction in the fixed body;

a spring provided to connect the base and the first slide with each other and move the first slide towards the rear end of the linear portion when the first transfer unit is moved to the linear portion from the curved portion; and an attractive power supply unit configured to supply a power to the second slide to move the second slide relative to the first slide and towards the rear end of the linear portion.

16. The drawer guide of claim 1, further comprising a first stopper configured to restrict rearward movement of the first slide.

17. The drawer guide of claim 16, wherein the attractive power supply unit is configured to move the second slide rearward when the second slide is positioned rearward than a reference position.

18. The drawer guide of claim 17, wherein the reference position is located in a front side of the first stopper.

19. The drawer guide of claim 17, wherein the reference position is located in a same position as the first stopper or is located in a rear side of the first stopper.

* * * * *